US007372202B2

(12) United States Patent
Eden et al.

(10) Patent No.: US 7,372,202 B2
(45) Date of Patent: May 13, 2008

(54) PHASE LOCKED MICRODISCHARGE ARRAY AND AC, RF OR PULSE EXCITED MICRODISCHARGE

(75) Inventors: J. Gary Eden, Mahomet, IL (US); Ju Gao, Champaign, IL (US); Sung-o Kim, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 598 days.

(21) Appl. No.: 10/829,666

(22) Filed: Apr. 22, 2004

(65) Prior Publication Data

US 2005/0269953 A1 Dec. 8, 2005

(51) Int. Cl.
*H01J 17/49* (2006.01)
*H01J 17/04* (2006.01)

(52) U.S. Cl. ..... 313/582; 313/631; 372/61; 372/65

(58) Field of Classification Search ..... 313/582, 313/586, 567
See application file for complete search history.

(56) References Cited

U.S. PATENT DOCUMENTS 4,367,554 A 1/1983 Schlossberg
4,475,060 A * 10/1984 Aboelfotoh ..... 313/587
4,720,706 A * 1/1988 Stine ..... 345/84
4,803,402 A * 2/1989 Raber et al. ..... 313/509
4,843,281 A * 6/1989 Mendelsohn ..... 313/587
4,956,577 A * 9/1990 Parker ..... 313/634
5,132,811 A * 7/1992 Iwaki et al. ..... 359/6
5,984,747 A * 11/1999 Bhagavatula et al. ..... 445/24
6,016,027 A * 1/2000 DeTemple et al. ..... 313/356
6,043,604 A * 3/2000 Horiuchi et al. ..... 313/582
6,194,833 B1 * 2/2001 DeTemple et al. ..... 313/631
6,456,007 B1 * 9/2002 Ryu et al. ..... 313/586
6,867,548 B2 * 3/2005 Eden et al. ..... 315/56
7,026,640 B2 * 4/2006 Nathan et al. ..... 257/9
2003/0080688 A1 * 5/2003 Eden et al. ..... 315/169.3
2006/0038490 A1 * 2/2006 Eden et al. ..... 313/582
2006/0071598 A1 * 4/2006 Eden et al. ..... 313/631
2007/0108910 A1 * 5/2007 Eden et al. ..... 313/631

OTHER PUBLICATIONS

D.G. Youmans, "Phase Locking of Adjacent Channel Leaky Waveguide CO2 Lasers", Appl. Phys. Lett. 44 (4), Feb. 15, 1984, pp. 365-367.

(Continued)

*Primary Examiner*—Nimeshkumar D. Patel
*Assistant Examiner*—Peter Macchiarolo
(74) *Attorney, Agent, or Firm*—Greer, Burns & Crain, Ltd.

(57) ABSTRACT

The invention is directed to a method and apparatus for phase-locking microdischarge device arrays and an ac, rf, or pulse-excited microdischarge. The invention provides output from a non-laser optical source that is a phase-locked array of microdischarges formed of microdischarge cavities containing discharge filler and excitation electrodes. In exemplary embodiments, entire arrays of microdischarge device optical emitters that are not lasers can be fabricated into a surface area having a largest dimension smaller than the coherence length of at least one of the emissions produced by the individual elements. In other embodiments, arrays of microdischarge devices configured in a Fresnel pattern constitute a lens suitable for both producing and focusing light.

24 Claims, 4 Drawing Sheets

OTHER PUBLICATIONS

L.A. Newman, R.A. Hart, J.T. Kennedy, A.J. Cantor, A.J. DeMaria, "High Power Coupled CO2 Waveguide Laser Array", Appl. Phys. Lett. 48 (25), Jun. 23, 1986, pp. 1701-1703.

J.E. Ripper, T.L. Paoli, "Optical Coupling of Adjacent Stripe-Geometry Junction Lasers", Applied Physics Letters, vol. 17, No. 9, Nov. 1, 1970, pp. 371-373.

J. Katz, S. Margalit, A. Yariv, "Diffraction Coupled Phase-Locked Semiconductor Laser Array", Appl. Phys. Lett. 42 (7), Apr. 1, 1983, pp. 554-556.

M. Oka, H. Masuda, Y. Kaneda, S. Kubota, "Laser-Diode-Pumped Phase-Locked Nd:YAG Laser Arrays", IEEE Journal of Quantum Electronics, vol. 28, No. 4, Apr. 1992, pp. 1143-1147.

* cited by examiner

PHASE LOCKED MICRODISCHARGE ARRAY AND AC, RF OR PULSE EXCITED MICRODISCHARGE

STATEMENT OF GOVERNMENT INTEREST

This invention was made with Government assistance under U.S. Air Force Office of Scientific Research grant No. F49620-00-1-0372. The Government has certain rights in this invention.

FIELD OF THE INVENTION

A field of the invention is microdischarge devices and arrays. Additional fields of the invention include all fields making use of coherent light. For example, the invention may be applied in the fields of fiber optic communications, biomedical diagnostics, and environmental sensing.

BACKGROUND OF THE INVENTION

Lasers undergird a wide variety of products and applications in fields such as optoelectronics, medicine, environmental sensing, and manufacturing because of the unique properties of the coherent emission (light) they produce. Semiconductor lasers have proven to be of particular value because of their generally small size and cost, but for some applications the beam quality (beam divergence and mode) leaves much to be desired. Coupling semiconductor laser radiation into an optical fiber, for example, is often complicated by the aspect ratio of the output beam. The output of a semiconductor laser may diverge in an elliptical pattern, and collimation and beam shaping is generally required to couple the laser radiation into an optical fiber, for example, or to make use of it in other applications.

It has long been known that individual lasers can be phase-locked, yielding an array consisting of two or more individual sources that behaves as though it were a single emitter. Phased arrays are ubiquitous in science and engineering because a properly phased collection of sub-systems emulates a single large system. Ripper and Paoli demonstrated phase-locking of semiconductor lasers in 1970 (J. E. Ripper and T. L. Paoli, *Appl. Phys. Lett.* 17, 371 (1970)) and Schlossberg described in U.S. Pat. No. 4,367,554 the phase-locking of $CO_2$ lasers. Today, arrays of $CO_2$ lasers locked in phase are able to produce hundreds of watts of power in the infrared from an exceptionally small package.

It should be emphasized that phase-locking of these and other lasers is motivated by the fact that phase locking allows the output of a number of individual sources, each producing modest power, to be combined to yield much higher powers while still preserving the phase characteristics of a single high quality source. However, the prior art of phase-locked optical sources considers lasers exclusively. Optical sources are often characterized by the degree of spatial coherence they possess, which is generally expressed in terms of the coherence length. Most lasers have a high degree of spatial coherence and phase locking an ensemble of lasers usually requires locating the individual lasers within one coherence length of each other.

SUMMARY OF THE INVENTION

In the past, non-laser discharge sources of optical radiation have been largely viewed as incoherent because the physical size of discharge devices has generally been larger than, or comparable to, the coherence length of the emitted radiation. This invention provides a method and apparatus for phase-locking microdischarge device arrays. The invention provides output from a non-laser optical source that is a phase-locked array of microdischarges. In exemplary embodiments, entire arrays of microdischarge device optical emitters that are not lasers can be fabricated into a surface area having a largest dimension smaller than the coherence length of at least one of the emissions produced by the individual elements. In other embodiments, arrays of microdischarge devices configured in a Fresnel pattern constitute a lens suitable for both producing and focusing light. Arrays of the invention may be driven by dc or ac, RF or pulsed excitation. Another embodiment of the invention concerns an ac, RF or pulse excited microdischarge device.

DETAILED DESCRIPTION OF THE PREFERRED EMBODIMENTS

Figure 1:
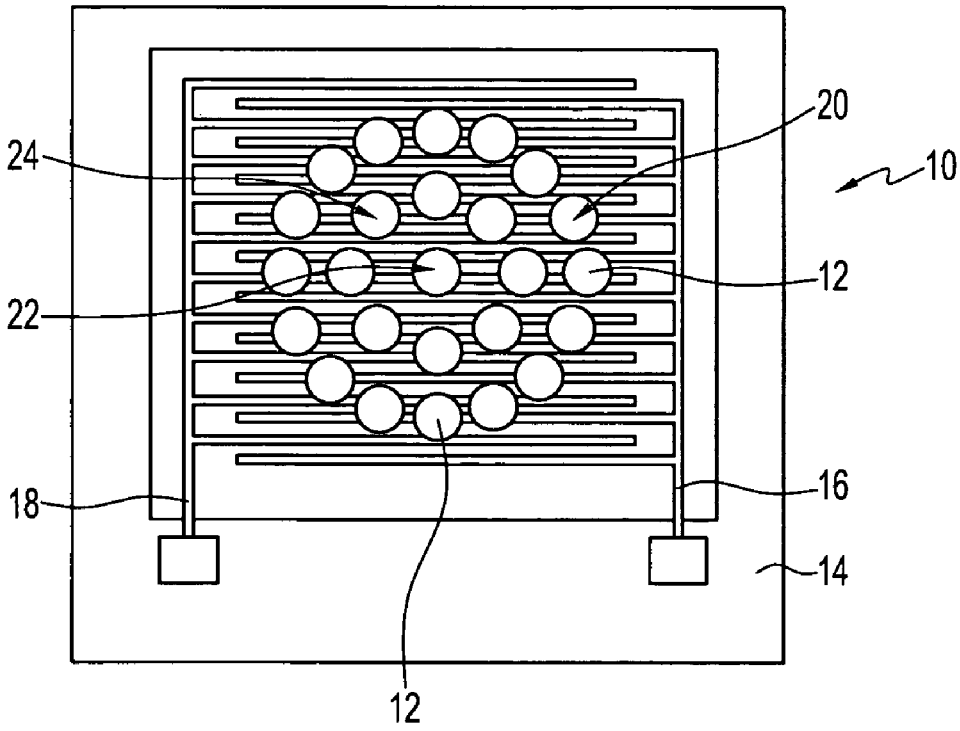
FIG. 1 shows a schematic top view of an exemplary embodiment microdischarge array light source.

Embodiments of the invention concern an array of microdischarge devices formed from microdischarge cavities including discharge medium and excitation electrodes. An array of the invention includes a plurality of microdischarges, with at least one of the individual devices in the array being spaced from another device in the array by no more than the coherence length of at least one of the emission lines produced in the devices. Excitation of an array of the invention can produce a phase-locked response, indicated by a coherent interference structure in the spatial profile of the optical output, and the array accordingly forms a phased array, with a partial or complete phase locking of microdischarge array. An array of the invention offers the opportunity to engineer the optical wavefront produced by the array through constructive and destructive interference.

A preferred array of the invention includes a plurality of microdischarge devices arranged in a Fresnel pattern. The array in a Fresnel pattern operates as an optically active lens. Embodiments of the invention include arrays arranged in Fresnel patterns, with the individual microdischarge devices coupling optically to form a coherent light source characterized by an interference pattern at the focal point of the array. In embodiments of the invention, an electrode pair, such as a pair of interdigitated electrodes, provide power to excite microdischarges arranged in a Fresnel pattern. In another embodiment of the invention, multiple sets of interdigitated electrodes facilitate alignment of the array structure during fabrication and permit a selective excitation of at least one of the concentric rings of microdischarges constituting the Fresnel pattern. Still another embodiment is one in which individual microdischarges are spaced sufficiently close, and separated by a transparent medium, that the microdischarges phase lock but the microdischarges are not arranged in a Fresnel pattern.

Microdischarge arrays of the invention have many applications, and may be used in several instances as a substitute for semiconductor lasers or other light sources. An exemplary application is for optical communication systems and/or data links. In such systems, a microdischarge array of the invention provides an optical source for a light carrier wave. An advantage provided by a microdischarge array in such applications is that the array of the invention is inexpensive to fabricate and, when the array is in a Fresnel configuration, provides a focused beam at a given focal length. Coupling the light output of a microdischarge array of the invention into a transmissive medium, e.g., a multimode optical fiber, is therefore straightforward. Another application for phase-locked microdischarge arrays is the production and focusing of ultraviolet light for the purpose of irradiating living cells in a biomedical diagnostic system such as a cell sorter or flow cytometry system.

More generally, a phase-locked microdischarge array of the invention is an important new device that can form a substitute for compact semiconductor lasers or other optical sources in many applications, such as illumination for microscopy.

Preferred embodiment arrays of the invention act as a single source that is capable of producing a tightly focused beam, the energy of microdischarges in the array combining to produce a significantly more powerful beam than is available from a single microdischarge device. An array of the invention is also highly compact.

For example, a substrate of the invention might be less than one mm thick and have a diameter of only a few millimeters, for example <3 mm. Preferred Fresnel array embodiments of the invention effectively produce a combined light source and lens.

Considered with the small size of an array of the invention, with an exemplary largest ring in a Fresnel pattern having a diameter of 1-2 mm, the invention is particularly well-suited for launching optical power into a multi-mode optical fiber. Other preferred embodiments of the invention include flow cytometry devices. A compact, phase-locked microdischarge array of the invention can provide light to irradiate living cells passing an examination station under the control of a controller. The total optical power (and intensity) present at a cell may be changed, for example, by varying the number of phase-locked microdischarges that are excited to provide the optical power level appropriate for examining a cell via fluorescence or for cell necrosis. In another embodiment of the invention, a phase-locked microdischarge device array provides a light source for affecting a memory and/or read-out effect in a medium. A phase-locked array is separated from the medium by approximately one focal length of a Fresnel microdischarge array. A controller controls the microdischarge array by varying the number of rings in the array that are ignited or by varying the phase of the wavefront with the result that the output of the microplasma array is focused on different portions of the phase change media.

The invention will now be illustrated by discussing several preferred embodiment devices. In describing the invention, particular exemplary devices, formation processes, and device applications will be used for purposes of illustration. Dimensions and illustrated devices may be exaggerated for purposes of illustration and understanding of the invention. The elements of the drawings are not necessarily to scale relative to one another. Schematic views will be understood by artisans as such views are commonly used in the art. Devices and arrays of the invention may be fabricated by processes well known to the semiconductor device and MEMs communities.

Figure 2:
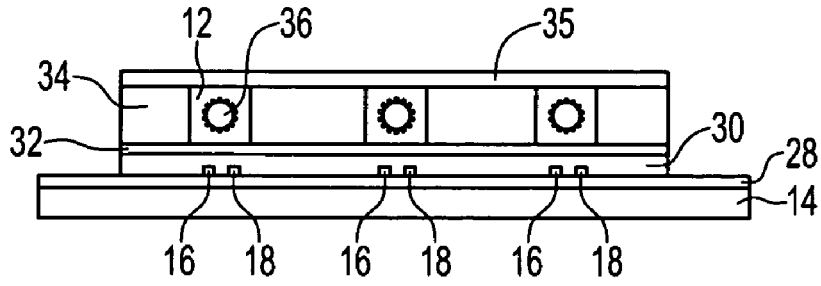
FIG. 2 shows a schematic cross-section of a the FIG. 1 device.

Referring now to FIGS. 1 and 2, a microdischarge array 10 comprising a plurality of microdischarge cavities 12 is shown. In the view of FIG. 1, the emission direction is out of the plane of the page. The array 10 of microdischarge cavities 12 is formed on a substrate 14, which can be, for example, a photosensitive glass. Interdigitated electrodes 16, 18 form electrode pairs that provide excitation to create a time-varying electromagnetic field in the microdischarge cavities, e.g., ac, RF, or pulsed excitation to the microdischarge cavities 12. The peak strength of the electric field produced in the microdischarge cavities must be sufficient to cause the production of plasma within the microdischarge cavities. Though not illustrated in FIG. 1, the electrodes 16, 18 may be connected to control circuitry, and the array itself may form part of an integrated circuit. In the embodiment of FIG. 1 the central microcavity (pixel) 22 and rings 20 and 24 of microdischarges are excited by an electromagnetic field created by the electrodes-when power (e.g., ac, RF, or pulsed power) is applied. However, it is straightforward to arrange the electrodes so that only the outermost ring 20 or the innermost pixel 22 or the middle ring 24 (or combinations thereof) are excited. In this manner, the rings 20-24 may be separately controlled. This effect can be used to alter the focal length.

Figure 3:
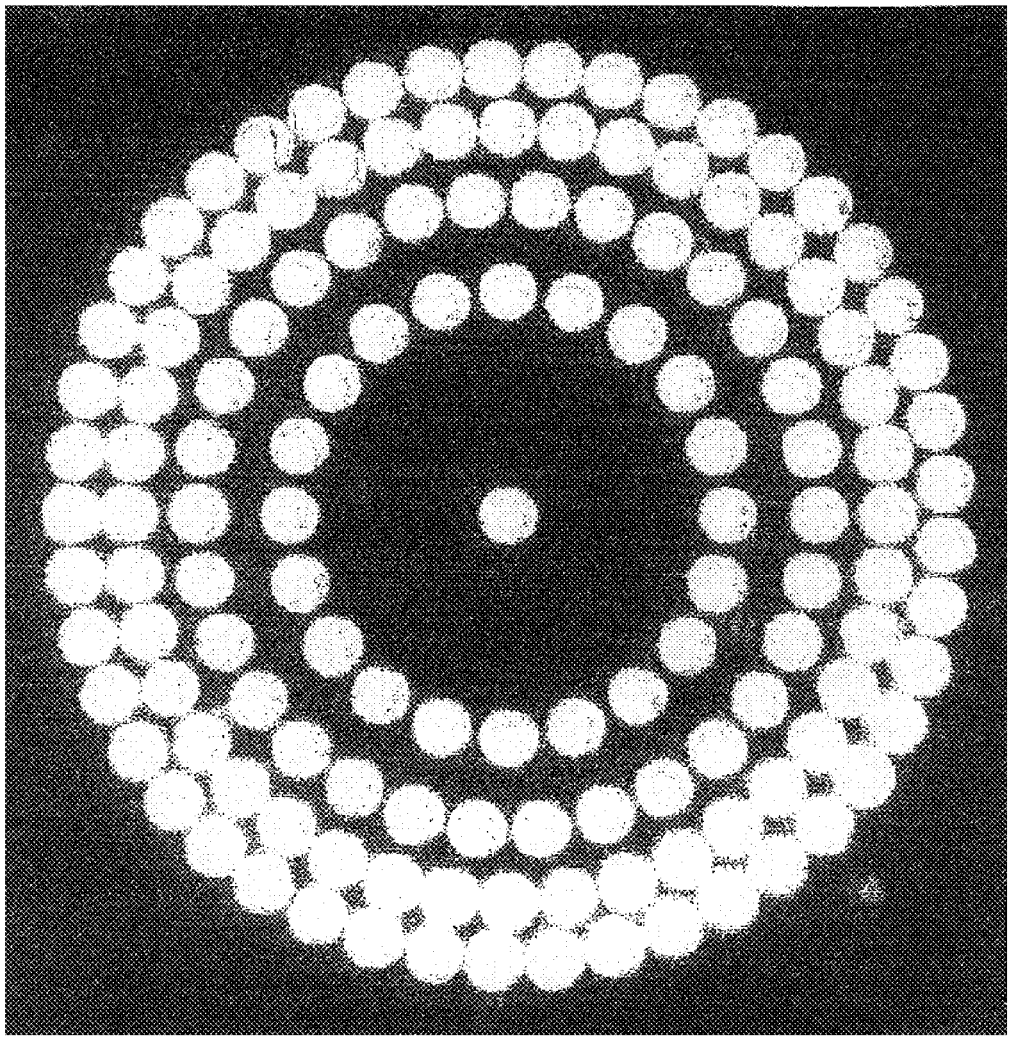
FIG. 3 is a microphotograph of a prototype phase-locked microdischarge array.

In other embodiments, more rings may be used and individually controlled by, for example, two or more sets of electrodes. FIG. 3 shows an actual image, photographed with a telescope and a CCD camera, of a prototype array in accordance with the invention. The example array is composed of 100 μm dia. microdischarge pixels. The visible light is produced by an ac discharge in neon gas in each microcavity and pairs of excitation electrodes can be seen in each of the microdischarges. In FIG. 3, the color appears slightly more yellow than is actually observed.

Referring again to FIG. 2, the array 10 is shown as being formed upon the substrate 14, which as another example might be a silicon wafer. The substrate also, for example, might be selected from the Group III-V semiconductor materials. In still other embodiments, the substrate may be plastic, glass, or another solid material onto which the remaining structure may be formed. For the array 10 of FIG. 2 formed on the silicon wafer or other semiconductor substrate, an insulating layer 28, e.g., silicon dioxide, provides electrical isolation from the electrodes 16, 18, which may be connected through the insulating layer 28 to other circuits on the substrate 14. A dielectric layer 30 prevents breakdown between the electrodes and may be chosen from a variety of well-known materials such as polyimide, silicon nitride, or silicon dioxide. A protective layer 32 is a robust dielectric such as magnesium oxide. The layers 30 and 32 are thin, preferably a few microns, as at least the peak electric field strength generated in the microdischarge cavities must be sufficient to produce a discharge in the gas(es) or vapors within the cavities.

Each microcavity 12 is formed in another substrate 34, for example, a dielectric material for electrically isolating each microcavity 12 from others. The dielectric substrate 34 is essentially transparent at a frequency of interest, namely, the frequency for phase locking. The transparency of the material of 34 may extend over a wavelength range encompassing two or more wavelengths produced by the microdischarges (output of the microdischarge cavities 12), thereby allowing two or more wavelengths to be phase-locked. Alternatively, substrate 34 may be chosen so as to be essentially transparent at only one wavelength. Thus, substrate 34 isolates each microdischarge electrically but couples the microdischarges optically at at least one wavelength.

A transparent top window 35 fabricated from a transparent material such as glass or quartz, is bonded or otherwise sealed to the substrate 34. The bottom electrodes 16, 18 produce an electric field that excites the vapor or gas discharge medium 36 contained within the microdischarge cavities 12. The window, i.e., fabricated from a substance transparent to the wavelength(s) of interest, 35 seals the discharge medium 36—a vapor or gas—in the microdischarge cavities 12. Application of power to the electrodes 16, 18 results in optical emissions from the discharge medium 36. If individual control of various microdischarge cavities 12 is not desired, common electrodes, such as electrodes 16, 18, are used to excite discharges in the microdischarge cavities 12, while multiple electrode pair embodiments may provide individual control, such as selective excitation of only rings 20 and 24.

The lower size limit of the diameter of the microdischarge cavities 12 in which the microdischarges are generated is limited primarily by the microfabrication techniques used to form the microdischarge cavities. Although the microdischarge cavities (for the prototype phased arrays produced to date) are cylindrical and have typical diameters of 75 or 100 μm, fabricating microplasma devices of much smaller (<10 μm) or larger sizes is straightforward with well-known microfabrication techniques. Also, the cross-section of the individual microdischarge devices need not be circular, though that is the shape of the microdischarge cavities 12 in the exemplary embodiment of FIGS. 1 and 2.

The size(s) of the individual devices and the overall array are determined by several considerations. To achieve phase-locked operation, the spacing between individual microdischarge devices and the cross-sectional dimensions of each device must be smaller than the coherence length of at least one of the radiative emission lines to be produced in the microdischarge array. The microdischarge devices may produce radiation at many disparate wavelengths and the array may be designed so as to phase lock radiation of a particular wavelength or a range in wavelengths.

One factor that determines the response of the array is the discharge medium 36 in the microdischarge cavities 12. Microdischarge devices operating in neon gas, for example, produce strong emission in the red region of the visible and weaker emission in the ultraviolet.

The material of the substrate 34 also impacts the response of the array. This may be used to control the wavelength of the phase-locked response of the array. For example, the array may be designed to achieve phase-locking in the red but not the ultraviolet. Phase-locking requires that the individual microdischarges (in microdischarge cavities 12) be optically coupled at the wavelength of interest. One way to accomplish this is to fabricate the microdischarge array in a material that is optically transmissive at the wavelength of interest. This allows optical radiation at the desired wavelength to pass from one microdischarge device and into an adjacent device.

Figure 4:
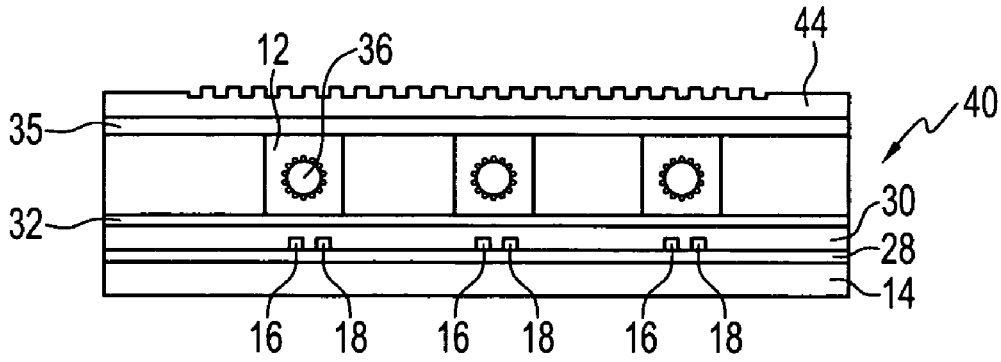
FIG. 4 is a schematic cross-section view of an exemplary embodiment microdischarge array.

Another approach is to cap the microdischarge array with a surface having a grating structure that optically couples at least two of the microdischarge cavities 12. The grating structure deflects radiation of a particular wavelength (or range of wavelengths), produced in one microdischarge device, into surrounding devices. FIG. 4 shows such an array 40. The array 40 is otherwise the same as the arrays of FIGS. 1 and 2, but includes a grating 44 for optically coupling microdischarge devices. For optimal performance, it is preferred that not simply two or more microdischarge devices (within microdischarge cavities 12) lie within one coherence length of one another but rather that each microdischarge cavity in the array lies within one coherence length of all other microdischarge cavities in the array.

Figure 5:
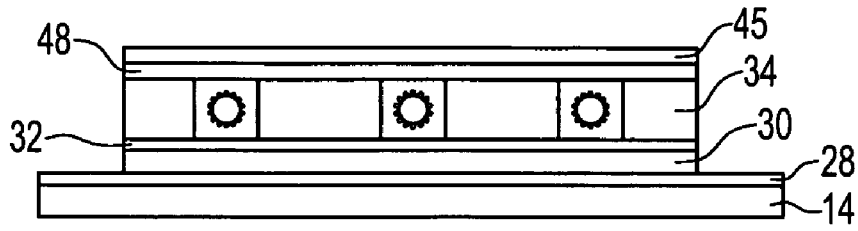
FIG. 5 is a schematic cross-section view of an exemplary embodiment microdischarge array.

FIG. 5 shows another embodiment, which is a variation of the FIG. 4 embodiment. In this case, the substrate 34 is formed of or carrying a conductive or semiconductor material, and the microdischarge cavities 12 are hollow cathode microdischarge cavities. The substrate 34 in this case forms a common cathode, and is isolated from a second electrode 45 (which is a material, such as indium tin oxide, that is preferably transparent at visible wavelengths) by an insulator film 48. In the FIG. 5 embodiment, the substrate 34, being itself conductive or semiconducting or, alternatively, supporting a semiconductive or conductive material on its surface in the microdischarge cavities 12, constitute an electrode making direct contact with the discharge medium and dc excitation (as well as ac, pulsed, RF, etc., excitation) may be used. Other electrode configurations are also possible for dc excitation, where an electrode is brought into direct contact with the discharge medium.

Another design consideration concerns preferred embodiment arrays arranged in a particular spatial configuration, a Fresnel pattern. If focusing of the light emerging from an array is desired, the microdischarge pixels can be disposed in rings. The radius of each ring is given by the expression $$\rho=\sqrt{2n\lambda b+n^2b^2} \tag{1}$$

where b is the desired focal length of the Fresnel array, n is the order (number) of the ring and λ is the wavelength of the light. It should be noted that the performance of the Fresnel lens improves with an increasing number of rings but we have found that skipping rings to obtain a larger spacing between rings of pixels also yields Fresnel structures that work well. From eqn. (1), it is clear that constructing active (microdischarge) Fresnel structures is most difficult at short wavelengths (λ) and with small focal lengths.

The small size of the microdischarge cavities, and the ability to pack the microdischarge cavities close together effectively creates point sources of radiation within a single coherence length of other adjacent microdischarge cavities. This provides the basis for a phased response of the array.

The type of discharge medium used in the microdischarge cavities 12 can alter the nature of the display. Discharge media in exemplary embodiments include a wide variety of vapors and gases such as the atomic rare gases, $N_2$, and the rare gas-halide molecules (i.e., rare gas-halogen donor gas mixtures). Each of the microdischarges is operated at pressures up to and beyond one atmosphere. Fabrication and the operation of microdischarges are discussed in the following U.S. patents that are incorporated by reference herein: U.S. Pat. No. 6,563,257 entitled Multilayer ceramic microdischarge device; U.S. Pat. No. 6,194,833 entitled Microdischarge lamp and array; U.S. Pat. No. 6,139,384 entitled Microdischarge lamp formation process; and U.S. Pat. No. 6,016,027 entitled Microdischarge lamp.

Figure 6:
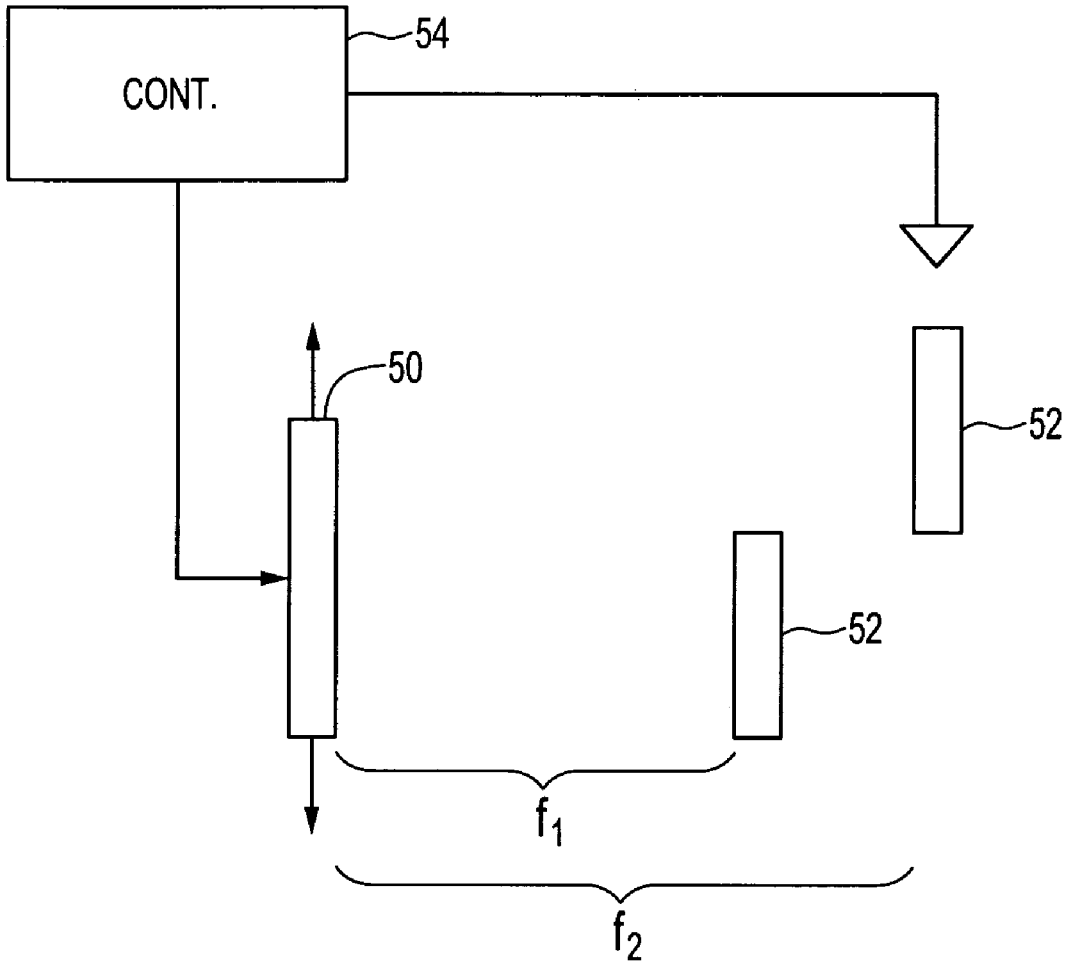
FIG. 6 is a block diagram of an exemplary embodiment system including a coherent light source target and a phase-locked microdischarge array.

Referring now to FIG. 6, an exemplary system of the invention is shown. An array or arrays of microdischarges 50 are disposed to direct light toward one or more targets 52. The target(s) may be disposed at different focal lengths, $f_1$, and $f_2$, away from the array 50, which might, for example have its focal length selectable by controlling the number of active rings in a Fresnel pattern of the array 50. A controller 54 directs the activation of the array, and might also, for example, cause one of the array 50 or targets 52 to move relative to one another by micropositioners. The targets may be any number of devices or materials such as memory media, display media, or transmission media such as optical fiber, a target in a flow cytometry system, etc.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A phased-locked microdischarge array, comprising:

a substrate;

a plurality of microdischarge cavities in said substrate containing discharge medium, said microdischarge cavities being sized to produce plasma within said microdischarge cavities and being arranged such that at least some of the microdischarge cavities are within the coherence length of at least one emission line produced by said discharge medium contained in said microdischarge cavities;

at least one pair of electrodes for exciting said plurality of microdischarge cavities for excitation of said discharge medium by application of electrical power.

2. The microdischarge array of claim 1, wherein said at least one pair of electrodes are isolated from each other and said discharge medium such that ac, rf, or pulsed excitation applied to said pair of electrodes stimulates discharge from said discharge medium.

3. The microdischarge array of claim 2, wherein a dielectric layer isolates said at least one pair of electrodes from each other and said discharge medium.

4. The microdischarge array of claim 3, further comprising a protective layer between said dielectric layer and said plurality of microdischarge cavities.

5. The microdischarge array of claim 1, wherein said microdischarge cavities array are arranged to approximate a Fresnel pattern, and groups of said microdischarge cavities comprise approximate rings in the Fresnel pattern.

6. The microdischarge array of claim 1, wherein said substrate comprises one of said at least one pair of electrodes and said microdischarge cavities are formed as a hollow cathodes that penetrate said substrate, the array further comprising:

a transparent electrode forming the other of said at least one pair of electrodes; and a dielectric layer to isolate said transparent electrode from said substrate.

7. The microdischarge array of claim 6, wherein said plurality of microdischarge cavities are arranged to approximate a Fresnel pattern.

8. The microdischarge array of claim 1, wherein said plurality of microdischarge cavities are arranged to approximate a Fresnel pattern.

9. The microdischarge array of claim 1, wherein said substrate comprises photosensitive glass, with said plurality of microdischarge cavities etched into said photosensitive glass.

10. The microdischarge array of claim 1, wherein said discharge medium is selected from the group consisting of the atomic rare gases, $N_2$, and the rare gas-halide molecules.

11. The microdischarge array of claim 10, wherein said discharge medium comprises neon gas.

12. An optical communication system, comprising:

a microdischarge array of claim 1, the array being optically coupled to an optical transmission medium; and a controller for controlling delivery of electrical power to said at least one pair of electrodes to stimulate said microdischarge array to launch optical power into said optical transmission medium.

13. The optical communication system of claim 12, wherein said optical transmission medium comprises an optical fiber.

14. A flow cytometry system, the system comprising:

a phased-locked microdischarge array, including, a substrate;

a plurality of microdischarge cavities in said substrate containing discharge medium, said microdischarge cavities being sized and arranged such that at least some of the microdischarge cavities are within the coherence length of at least one emission line produced by said discharge medium contained in said microdischarge cavities;

at least one pair of electrodes for exciting said plurality of microdischarge cavities for excitation of said discharge medium by application of electrical power;

a flow system including an examination station disposed at a focal length of the microdischarge array for passing living cells within the focal length of the microdischarge array; and a controller for controlling delivery of electrical power to said at least one pair of electrodes to stimulate said microdischarge array to direct optical power into said examination station.

15. A memory device, the device comprising:

a microdischarge array of claim 1;

a memory medium disposed at a focal length of the microdischarge array; and a controller for controlling delivery of electrical power to said at least one pair of electrodes to stimulate said microdischarge array to direct optical power onto said memory medium.

16. The microdischarge array of claim 1, wherein said at least one pair of electrodes are separated from said discharge medium to excite said discharge medium when ac, rf, or pulsed power is applied to said electrodes.

17. The microdischarge array of claim 1, wherein said at least one pair of electrodes is arranged to have an electrode directly contact said discharge medium to excite said discharge medium when ac, RF, pulsed or dc power is applied to said electrodes.

18. The microdischarge array of claim 1, further comprising means for sealing said discharge medium in said plurality of microdischarge cavities.

19. The microdischarge array of claim 1, further comprising a grating optically coupled to said microdischarge cavities.

20. A microdischarge array, comprising:

a substrate;

a plurality of microdischarge cavities in said substrate, said microdischarge cavities being sized to produce plasma within said microdischarge cavities and being arranged in a Fresnel pattern, at least a portion of the substrate between said plurality of microdischarge cavities being optically transparent to an emission wavelength of the microdischarge array;

discharge medium contained in said microdischarge cavities; and electrodes for stimulating said discharge medium.

21. A microdischarge array, comprising:

a semiconductor substrate;

at least one pair of electrodes;

an insulation layer to isolate said electrodes from said semiconductor substrate;

a dielectric layer to isolate said at least one pair of electrodes from each other;

a dielectric substrate;

a plurality of microdischarge cavities containing discharge medium in said dielectric substrate, said microdischarge cavities being sized to produce plasma within said microdischarge cavities and being arranged to produce a phase-locked response when excited, said plurality of microdischarge cavities being physically isolated from said at least one pair of electrodes by said dielectric layer; and a transparent layer sealing the discharge medium said plurality of microdischarge cavities.

22. A microdischarge array of claim 21, further comprising a protective layer disposed between said plurality of microdischarge cavities and said dielectric layer.

23. The microdischarge array of claim 21, further comprising a grating optically coupled to said plurality of microdischarge cavities.

24. The microdischarge array of claim 21, wherein all of said microdischarge cavities lie within one coherence length of at least one emission line produced by the discharge medium from all other ones of said microdischarge cavities.

* * * * *

UNITED STATES PATENT AND TRADEMARK OFFICE

CERTIFICATE OF CORRECTION

PATENT NO. : 7,372,202 B2
APPLICATION NO. : 10/829666
DATED : May 13, 2008
INVENTOR(S) : Eden et al.

It is certified that error appears in the above-identified patent and that said Letters Patent is hereby corrected as shown below:

Title page, item [56] References Cited, OTHER PUBLICATIONS (Continued):

Page 2, delete "1143-1147" and insert -- 1142-47 -- therefor.

Column 2, line 17, after "BRIEF DESCRIPTION OF THE DRAWINGS," please insert the following paragraph.

-- The patent or application file contains one drawing executed in color. Copies of this patent or patent application publication with color drawing(s) will be provided by the Office upon request and payment of the necessary fee. --

Column 3, replace lines 20-35 with the following paragraph.

-- More generally, a phase-locked microdischarge array of the invention is an important new device that can form a substitute for compact semiconductor lasers or other optical sources in many applications, such as illumination for microscopy. Preferred embodiment arrays of the invention act as a single source that is capable of producing a tightly focused beam, the energy of microdischarges in the array combining to produce a significantly more powerful beam than is available from a single microdischarge device. An array of the invention is also highly compact. For example, a substrate of the invention might be less than one mm thick and have a diameter of only a few millimeters, for example <3mm. Preferred Fresnel array embodiments of the invention effectively produce a combined light source and lens. --

Signed and Sealed this

Sixteenth Day of September, 2008

JON W. DUDAS
*Director of the United States Patent and Trademark Office*